United States Patent [19]

Hori et al.

[11] Patent Number: 4,716,279

[45] Date of Patent: Dec. 29, 1987

[54] SELF-TEMPERATURE CONTROLLING TYPE HEATING DEVICE

[75] Inventors: Makoto Hori, Ohgaki; Toshiatsu Nagaya, Kariya; Hirokatsu Mukai; Hitoshi Niwa, both of Okazaki; Naoto Miwa, Tsushima, all of Japan

[73] Assignee: Nippondenso Co., Ltd., Kariya, Japan

[21] Appl. No.: 771,053

[22] Filed: Aug. 30, 1985

[30] Foreign Application Priority Data

Sep. 7, 1984 [JP] Japan ..... 59-188672

[51] Int. Cl.[4] ..... H05B 1/02

[52] U.S. Cl. ..... 219/541; 219/505

[58] Field of Search ..... 338/22; 219/504, 505, 219/530, 540, 541, 544, 552, 553

[56] References Cited

U.S. PATENT DOCUMENTS

| | | | |
|---|---|---|---|
| 2,966,646 | 12/1960 | Baasch | 338/22 R |
| 3,678,569 | 7/1972 | Giesfeldt et al. . | |
| 3,742,419 | 6/1973 | Martzloff | 338/22 R |
| 3,976,854 | 8/1976 | Ishikawa et al. | 338/22 R |
| 3,982,093 | 9/1976 | Henrion . | |
| 4,031,499 | 6/1977 | Brueckner | 338/22 R |
| 4,151,401 | 4/1979 | Van Bokestal et al. | 338/22 R |
| 4,200,970 | 5/1980 | Schonberger | 338/22 R |
| 4,251,793 | 2/1981 | Vind | 338/22 R |
| 4,316,080 | 2/1982 | Wroblewski | 219/504 |
| 4,336,444 | 6/1982 | Bice et al. . | |
| 4,413,301 | 11/1983 | Middleman et al. | 338/22 R |

FOREIGN PATENT DOCUMENTS

| | | |
|---|---|---|
| 3107290 | 1/1982 | Fed. Rep. of Germany . |
| 1571105 | 6/1969 | France . |
| 2159781 | 3/1973 | France . |
| 2490056 | 3/1982 | France . |
| 2510803 | 7/1982 | France . |

*Primary Examiner*—M. Jordan

*Attorney, Agent, or Firm*—Cushman, Darby & Cushman

[57] ABSTRACT

A self-temperature controlling type heating device comprises a positive temperature coefficient ceramic resistor having a thin layer portion, a first electrode provided on one face of the thin layer portion, a second electrode provided on the other face of the thin layer portion opposite to the first electrode, and at least one third electrode provided on the surface of the PTC ceramic resistor in spaced relation to the first electrode. An electric current is allowed to flow between the first and second electrodes to form a heating element, and an electric resistance value between the first and third electrodes is detected to thereby make a temperature control. Thus, a high output is obtained at a low voltage and the control temperature is freely varied.

6 Claims, 16 Drawing Figures

SELF-TEMPERATURE CONTROLLING TYPE HEATING DEVICE

BACKGROUND OF THE INVENTION

1. Field of the Invention

The present invention relates to a heating device utilizing a positive temperature coefficient (PTC) ceramic resistor in which an electric resistance value varies greatly by the order of about three to seven figures at and around a Curie temperature. More particularly, it relates to a self-temperature controlling type heating device which has a self-temperature temperature controlling function and in which the temperature to be controlled is variable.

2. Description Of The Prior Art

A positive temperature coefficient ceramic resistor has heretofore been utilized widely as an electric material; for example, it has been used practically as a contactless current control device for a motor start switch, as a temperature compensating thermistor and as a self-temperature controlling type heating device in a hair drier, a warm air heater, etc.

The specific resistance of a positive temperature coefficient ceramic resistor consisting principally of barium titanate ($BaTiO_3$) has heretofore been about 5 ohm·cm as a minimum value. Therefore, a self-temperature controlling type heating device using such a positive temperature coefficient ceramic resistor in the form of a thick film has encountered a limit in obtaining a high output at a low voltage. If the thickness of the positive temperature coefficient ceramic resistor is made smaller in order to compensate for this drawback, the positive temperature coefficient will be lowered, making it difficult to effect temperature control. Further, since the heat generating temperature of a positive temperature coefficient ceramic resistor is determined directly by its Curie temperature and the amount of radiation heat, it has been difficult to control the temperature in use.

Having made extensive studies about the positive temperature coefficient of a ceramic resistor, the present inventors found that the said coefficient was caused by grain boundaries of a positive temperature coefficient ceramic resistor. More particularly, the following phenomenon was found out. With increase of grain boundaries of a positive temperature coefficient ceramic resistor, the resistance variation width increases and the positive temperature coefficient appears remarkably. On the other hand, if a positive temperature coefficient ceramic resistor is constituted by a single layer of crystals to eliminate a grain boundary, the positive temperature coefficient disappears.

SUMMARY OF THE INVENTION

The present invention has been accomplished on the basis of the above knowledge.

It is an object of the present invention to provide a self-temperature controlling type heating device in which the control temperature is variable.

Another object of the present invention is to provide a self-temperature controlling type heating device which radiates a high output at a low voltage.

These and other objects have been attained by the self-temperature controlling type heating device comprising: a positive temperature coefficient ceramic resistor having a thin layer portion; a first electrode provided on one face of the said thin layer portion; a second electrode provided on the other face of the thin layer portion opposite to the first electrode; and at least one third electrode provided on the surface of the positive temperature coefficient ceramic resistor in spaced relation to the first electrode, in which an electric current is allowed to flow between the first and second electrodes to form a heating element, and an electric resistance value between the first and third electrodes is detected to thereby make a temperature control.

BRIEF DESCRIPTION OF THE DRAWINGS

The exact nature of this invention, as well as other objects and advantages thereof, will be readily apparent from consideration of the following specification relating to the annexed drawings in which.

DETAILED DESCRIPTION OF THE INVENTION

The positive temperature coefficient cermaic resistor used in the present invention means a resistor formed of a cermaic material whose resistance value increases as the temperature rises. A typical such resistor comprises a sintered product of barium titanate ($BaTiO_3$). Like sintered products with barium substituted by strontium, and barium or titanium substituted by lead, tin or zirconium are also employable.

It is desirable that the positive temperature coefficient ceramic resistor be formed on a substrate having heat resistance. As the substrate it is desirable to use an insulator such as alumina, barium titanate, glass and heat-proof resin. Electric conductors such as metals are also employable.

The positive temperature coefficient ceramic resistor may be formed in the shape of a thin film which has a substantially uniform thickness throughtout the entirety thereof, or in a stepped shape in section.

Where the positive temperature coefficient ceramic resistor is formed in the shape of a thin film, the thin layer portion occupies the entirety of the resistor. Where it is formed in a stepped shape in section, the thin layer portion corresponds to the portion having the smallest wall thickness.

Figure 1:
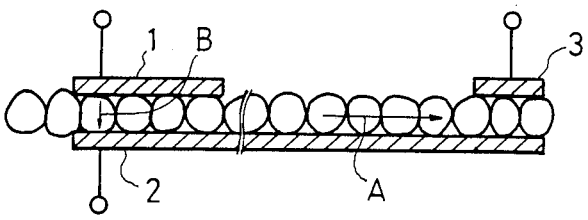
FIG. 1 is a side view schematically illustrating a base portion of the self-temperature controlling type heating device of the present invention.

As shown schematically in FIG. 1, it is desirable that the thin layer portion be formed by a single layer of its constituent crystals, because an electric current can be supplied in a thickness direction B of the thin layer portion without going through a grain boundary of the crystals. There may be present several layers of grain boundaries although the output will be somewhat decreased. In the case where the positive temperature coefficient ceramic resistor is formed of barium titanate, it is desirable that the thickness of the thin layer portion be in the range of 20 to 200 microns, more preferably 20 to 50 microns. This is because the crystal size of barium titanate is generally about 20 to 50 microns.

The first electrode is provided on one face of the thin layer portion, and the second electrode is provided for supplying an electric current in the thickness direction of the thin layer portion. More specifically, as shown schematically in FIG. 1, the second electrode 2 is provided on the other face of the thin layer portion in opposed relation to the first electrode 1. Further, for example as shown in FIG. 1, the third electrode 3 is provided in spaced relation to the first electrode 1 so that many grain boundaries of the constituent crystals of the positive temperature coefficient ceramic resistor may be present in the portion between the third electrode 3 and first electrode 1. This is effective in that positive temperature coefficient appears remarkably.

Figure 2:
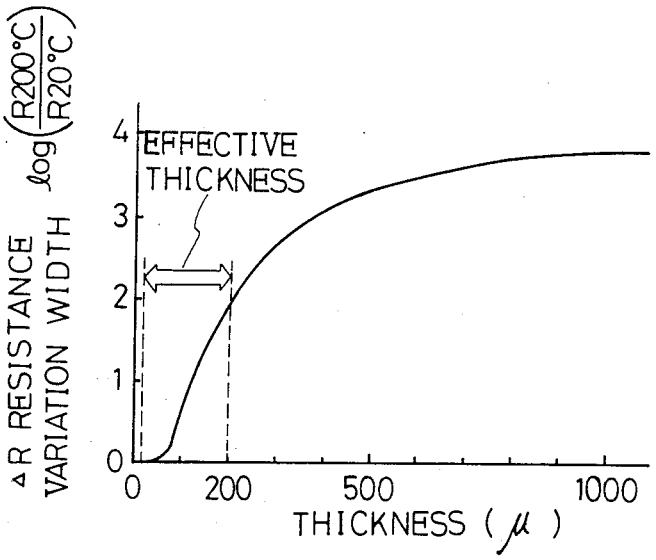
FIG. 2 illustrates diagrammatically the relationship between the thickness of a positive temperature coefficient ceramic resistor and resistance variation width.

FIG. 2 illustrates diagrammatically the relationship between the thickness of the positive temperature coefficient ceramic resistor and resistance variation width ($\Delta R$), in which $\Delta R$ is a logarithm of the ratio of resistance value at 200° C. to that at 20° C. of the resistor. It is apparent from this figure that the larger the thickness of the positive temperature coefficient ceramic resistor, that is, the larger the number of grain boundaries, the larger the $\Delta R$, that is, the more outstanding the positive temperature coefficient. It is also seen that at a thickness below 50 microns, $\Delta R$ becomes almost zero and positive temperature coefficient is extinguished. The positive temperature coefficient ceramic resistor used in the self-temperature controlling type heating device of the present invention is of a thickness in the range of 20 to 200 microns, which range corresponds to the range not larger than 2 in terms of $\Delta R$ in FIG. 2.

In the self-temperature controlling type heating device of the present invention, the portion between the first and second electrodes which portion scarcely contains a grain boundary, is utilized as a heating element of a low resistance not having a larger temperature dependence. Further, the portion between the first and third electrodes which portion contains many grain boundaries, is utilized as a resistor having positive temperature coefficient to control the temperature of the said heating element.

The first, second and third electrodes can be formed by such method as a chemical plating method, a paste printing method and a spray method. Materials employable for the electrodes include platinum, aluminum, nickel, silver, ruthenium oxide, ohmic electrode metals which contain silver and base metals, and the like. It is desirable that the melting points of those electrodes be higher than the sintering temperature of the positive temperature coefficient ceramic resistor. This is for preventing the melting of the electrodes at the time of sintering of the resistor.

A typical method of producing the base portion of the self-temperature controlling type heating device of the present invention will now be explained with reference to the process charts of FIG. 3(A)–FIG. 3(E).

Figure 3A:
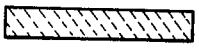
FIG. 3(A)–FIG. 3(E) are process charts illustrative of a typical manufacturing method for a base portion of a self-temperature controlling type heating device according to the first embodiment.
Figure 3B:
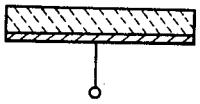
Figure 3C:
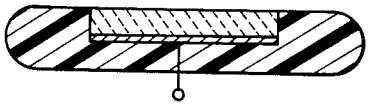
Figure 3D:
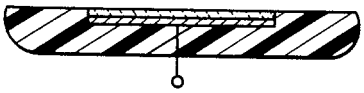
Figure 3E:
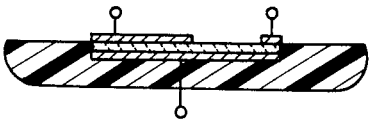

First, as shown in FIG. 3(A), a powdered raw material is sintered at 1,250°–1,400° C. to form a block of a positive temperature coefficient ceramic resistor. Then, as shown in FIG. 3(B), a second electrode is formed on the other face of the block, and thereafter, as shown in FIG. 3(C), the entirety of the block is embedded in a substrate. It is desirable that the substrate be formed of glass or epoxy resin. Then, as shown in FIG. 3(D), the substrate surface is ground together with the other face of the block. The grinding can be effected by a lapping method because a smooth ground surface can be formed. By so grinding, the thickness of the block can be adjusted to 20–200 microns, thereby permitting formation of a thin layer portion. As the case may be, the grinding may be carried out by a superfinishing method or a honing method. Then, as shown in FIG. 3(E), a first electrode is formed on the other face of the block which is the ground face, and a third electrode is formed on the same face in spaced relation to the first electrode.

The method for producing a base portion of the self-temperature controlling type heating device of the present invention is not limited to the method illustrated in FIG. 3(A)–FIG. 3(E). For example, a raw material of the positive temperature coefficient ceramic resistor may be treated by Physical Vapor Depresition (PVD) method to form a thin film on a substrate and this thin film may be used as the thin layer portion. As the pvd method, there may be employed evaporation, sputtering or ion implantation. As the case may be, the thin layer portion may be formed by forming on the surface of a $BaTiO_3$-based ceramic material a coating film using a solution or dispersion which contains a dopant to impart an electric conductivity to $BaTiO_3$ to allow positive temperature coefficient to be exhibited and then calcining the coating film. Further, as the case may be, a raw material of the positive temperature coefficient ceramic resistor may be treated by Chemical Vapor Deposition (CVD) method to form a thin film on a substrate and this thin film may be used as the thin layer portion. The CVD method comprises evaporating the raw material, then conducting the resulting vapor thereof into a reactor together with carrier gas and forming a thin film by a chemical reaction such as oxidation or thermal decomposition.

The self-temperature controlling type heating device of the present invention is obtained by attaching a circuit as device to the base portion thus produced. The circuit configuration is not specially limited if only the direction having no temperature dependence of the positive temperature coefficient ceramic resistor is used as a heating element and the direction having positive temperature coefficient is used for control.

The effects and advantages of the present invention are summarized below.

In the self-temperature controlling type heating device of the present invention, the positive temperature coefficient ceramic resistor is small in thickness and low in resistance, so a high output is obtained at a low voltage and thus the device is suitable as a heater which operates at a low voltage such as a car battery. Moreover, the temperature of the positive temperature coefficient ceramic resistor can be set as desired by using a variable resistor in the circuit. Further, a self-temperature control can be attained by detecting a resistance value of the portion having positive temperature coefficient. In other words, the same device can be utilized as a constant temperature heater capable of controlling the temperature freely. Thus, the effect thereof is outstanding.

In the self-temperature controlling type heating device of the present invention, when the second electrode is formed of platinum and the like, the second electrode is a non-ohmic electrode. In such a case, the second electrode and the n-type barium titanate semiconductor make p-n junction type resistance to the contact areas thereof. At low voltage levels, the current flows from the second electrode to the barium titanate semiconductor but is hard to flow in the reverse direction because the resistance in the contact areas serves as an obstacle. Therefore, the self-temperature controlling type heating device serves as a heater when the voltage is applied from the second electrode to the first electrode, while the self-temperature controlling type heating device is capable of controlling the temperature by measuring the resistance between the first electrode and the third electrode.

DETAILED DESCRIPTION OF THE EMBODIMENTS

Embodiments will be described below in detail.

FIRST EMBODIMENT

Figure 4:
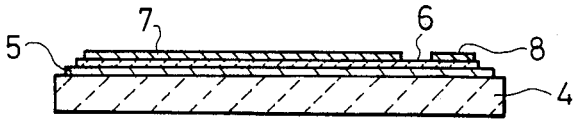
FIG. 4 is a longitudinal sectional view of the base portion of the self-temperature controlling type heating device according to the first embodiment.
Figure 5:
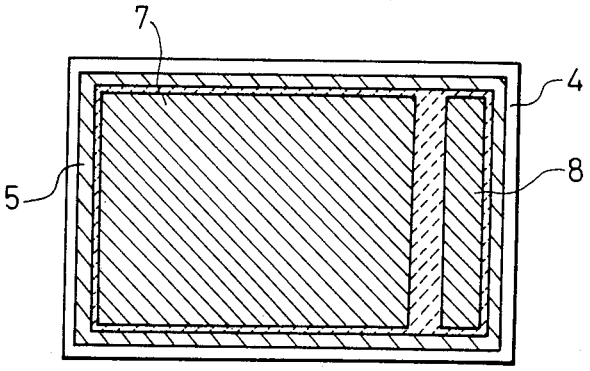
FIG. 5 is a plan view of the base portion of FIG. 4.
Figure 6:
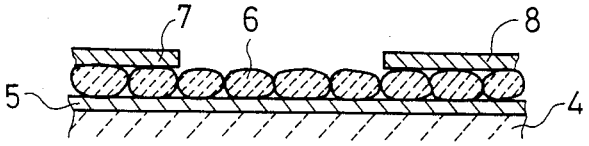
FIG. 6 is an enlarged longitudinal sectional view of a principal portion of the base portion of FIG. 4.

FIGS. 4 and 5 are a sectional view and a plan view, respectively, of a base portion of a self-temperature temperature controlling type heating device according to a first embodiment of the present invention. In this embodiment, a sheet-like substrate 4 was formed using barium titanate which is an insulator, and platinum was formed on an upper surface of the substrate 4 by paste printing to form a second electrode 5. Then, the entirety was dried at 150° C., and thereafter barium titanate was paste-printed in the form of a 25 micron thick thin film on the second electrode 5, followed by drying again and sintering at 1,250°-1,400° C., whereby a positive temperature coefficient ceramic resistor 6 was formed, which resistor was found to have a Curie temperature of 140° C. and a specific resistance of 5 ohm.cm. Then, nickel was applied onto an upper surface of the thus-formed resistor 6 by electroles plating to form a first electrode 7 and a third electrode 8, which electrodes are both ohmic electrodes. In the positive temperature coefficient ceramic resistor 6 of this embodiment, crystals are arranged laterally as a single layer between the electrodes, as shown in FIG. 6.

Figure 9:
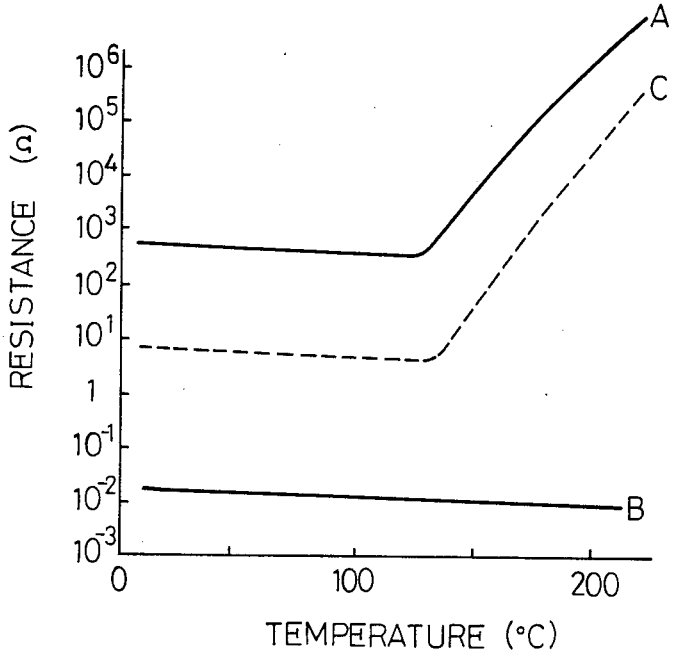
FIG. 9 is a diagram showing the relationship between temperature and resistance of the positive temperature coefficient ceramic resistor according to the first embodiment.

FIG. 9 shows resistance-temperature characteristics of the base portion of the self-temperature controlling type heating device of this embodiment. A characteristic curve A in this figure indicates a characteristic obtained when an electric current was supplied between the first electrode 7 and the third electrode 8. In this case, the resistance was in the range of $10^2$ to $10^3$ ohms at temperatures from 20° to 140° C., but it increased abruptly once the temperature exceeded 140° C., the resistance increased abruptly and positive temperature coefficient was observed.

On the other hand, a characteristic curve B shown in FIG. 9 indicates a characteristic obtained when an electric current was supplied between the first electrode 7 and the second electrode 5. In this case, the resistance was almost constant, around $10^{-2}$ ohms, at temperatures from 20° to 200° C. and positive temperature coefficient was extinguished.

A characteristic curve C is a comparative example. In this case, the same material as the positive temperature coefficient ceramic resistor 6 was sintered to the size of 10 cm×10 cm×1 cm under the same conditions, and an electric current was allowed to flow between electrodes formed on both faces in the thickness direction.

Figure 7:
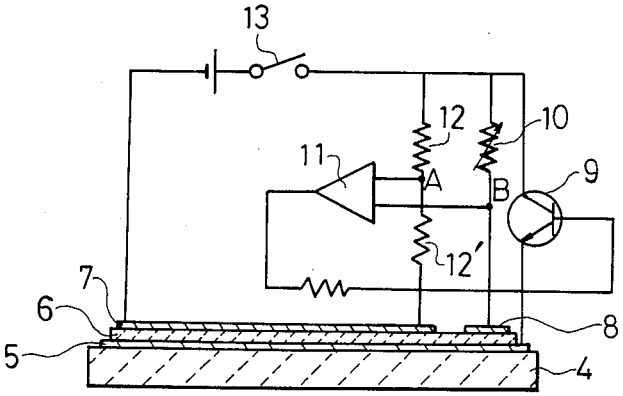
FIG. 7 illustrates diagrammatically an electric circuit used in the self-temperature controlling type heating device according to the first embodiment.

FIG. 7 shows an example of practical application of a self-temperature controlling type heating device obtained by attached a circuit to its base portion thus formed according to the first embodiment.

Upon turning ON of a switch 13, an electric current flows in the order of transistor 9, second electrode 5, positive temperature coefficient ceramic resistor 6 and first electrode 7, so that the resistor 6 generates heat. Then, with increase of the temperature beyond the Curie temperature, the resistance value of the portion between the first and third electrodes 7 and 8 having positive temperature coefficient also becomes larger gradually.

Figure 8:
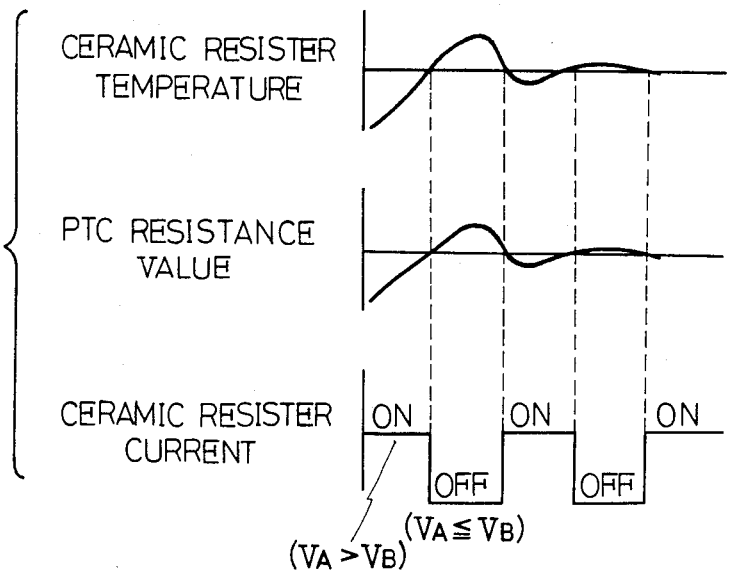
FIG. 8 illustrates an operation principle of the self-temperature controlling type heating device according to the first embodiment.

A voltage VA determined by reference resistors 12 and 12' and a voltage VB determined by a variable resistor 10, and by a resistance value between the first electrode 7 and the third electrode 8 are compared at a comparator 11 to control turn-on and turn-off of the transistor 9. More specifically, as shown in FIG. 8, when VA is larger than VB, current flows in the order of transistor 9, second electrode 5, positive temperature coefficient ceramic resistor 6 and first electrode 7, causing the resistor 6 to generate heat, while when VA is equal to or smaller than VB, current does not flow through the resistor 6. Thus, by turning ON and OFF of current flowing through the resistor 6, the device is used as a self-temperature controlling type heating device.

Further, the control temperature can be raised by increasing the value of the variable resistance 10 and lowered by decreasing the value of the same resistance. Thus, the heating device of the first embodiment has a self-temperature controlling function, in which the control temperature is variable.

SECOND EMBODIMENT

Figure 10:
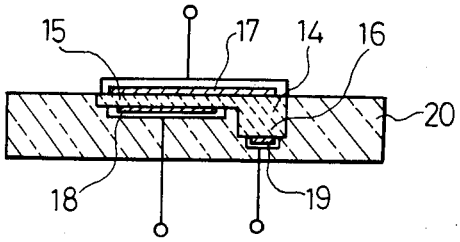
FIG. 10 is a longitudinal sectional view of a base portion of a self-temperature controlling type heating device according to a second embodiment of the present invention.

FIG. 10 is a sectional view of a base portion of a self-temperature controlling type heating device according to a second embodiment of the present invention, in which a positive temperature coefficient ceramic resistor 14 is stepped in section and embedded in a glass substrate 20. The resistor 14 has a thin layer portion 15 and a stepped thick layer portion 16 adjacent thereto. The thickness of the thin layer portion 15 and that of the thick layer portion 16 are 25 microns and 1,000 microns, respectively. A second electrode 18 is attached to the thin layer portion 15 in opposed relation to a first electrode 17, while a third electrode 19 is attached to the thick layer portion 16 on the side opposite to the first electrode 17.

In this embodiment, the positive temperature coefficient ceramic resistor 14 comprises mainly barium titanate and contains lead. The electrodes are composed of nickel and cover electrodes of silver formed thereon, and they are formed by electroless nickel plating and silver paste. The current applied between the first electrode 17 and the second electrode 18 and the current between the first electrode 17 and the third electrode 19 flow in the thickness direction of the positive temperature coefficient ceramic resistor 14. If an electric current is applied between the first electrode 17 and the second electrode 18 to allow it to flow through the thin layer portion 15, there will be developed a resistance characteristic scarcely including positive temperature coefficient, and thus the resistor is used as a heating element of a low resistance having no temperature dependence. On the other hand, if an electric current is applied between the first electrode 17 and the third electrode 19 to allow it to pass through the thick layer potion 16, there wil be developed a positive temperature coefficient according to the thickness of the thick layer portion 16, and so the resistance value is detected to control the temperature.

THIRD EMBODIMENT

Figure 11:
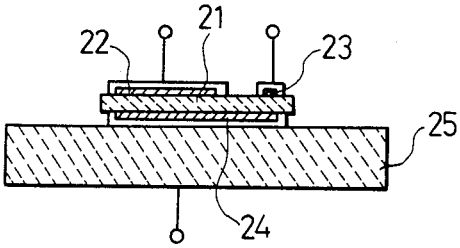
FIG. 11 is a longitudinal sectional view of a base portion of a self-temperature controlling type heating device according to a third embodiment of the present invention.

FIG. 11 is a sectional view of a base portion of a self-temperature controlling type heating device according to a third embodiment of the present invention. In this embodiment, the thickness of a positive temperature coefficient ceramic resistor 21 is set at 25 microns, and a first electrode 22 and a third electrode 23 are formed on one face of the resistor 21, while a second electrode 24 (a non-ohmic electrode) is formed substantially throughout the overall length of the other face of the resistor, and the entirety including the resistor and the electrodes is provided on a substrate 25. The substrate 25, which is formed of an electrically conductive material such as silicon carbide (SiC), also serves as an electrode.

In the embodiment illustrated in FIGS. 10 and 11, the first electrodes 17, 22 and the third electrodes 19, 23 may be formed in the shape of comb teeth.

FOURTH EMBODIMENT

Figure 12:
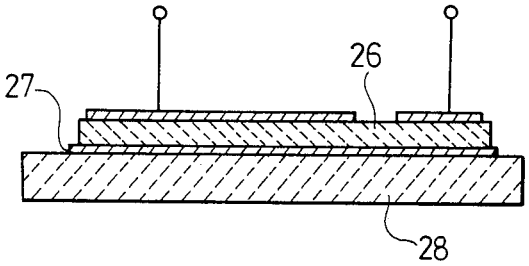
FIG. 12 is a longitudinal sectional view of a base portion of a self-temperature controlling type heating device according to a fourth embodiment of the present invention.

FIG. 12 illustrates a base portion of a self-temperature controlling type heating device according to a fourth embodiment of the present invention. In this embodiment, a substrate 28 is formed of alumina so as to have heat resistance and an insulating property, and on an upper surface of a second platinum electrode 27 is formed a positive temperature coefficient ceramic resistor 26 at a thickness of 30 microns from a sintered product of barium titanate.

The base portion in the above second, third and fourth embodiments are used as practically self-temperature controlling type heating devices after attaching thereto a circuit similar to that used in the first embodiment, although the circuit to be used is not limited thereto.

What is claimed is:

1. A self-temperature controlling type heating device comprising:

a ceramic resistor having:

a first domain which has a substantially low resistance and hardly or never exhibits a positive temperature coefficient, said first domain being designed to have a thickness in which a logarithm of a ratio of resistance value at 200° C. to that of 20° C. is not more than 2; and a second domain which has a higher resistance than said first domain and remarkably exhibits a positive temperature coefficient, said second domain having a characteristic in which a logarithm of a ratio of resistance value at 200° C. to that of 20° C. is more than 2.

first and second electrodes provided on said first domain to flow an electric current through said first domain and allow said first domain to generate heat, a third electrode provided on said second domain to flow an electric current through said second domain in cooperation with said first electrode, and an electric control circuit for controlling the electric current flow in said first domain in accordance with electric resistance variation of said second domain which is caused by the heating effect of the heat generation of said first domain.

2. A self-temperature controlling type heating device according to claim 1, wherein:

said ceramic resistor has a thin layer which is principally composed of barium titanate, said first electrode is formed on one face of said thin layer, said second electrode is formed on the other face of said thin layer in opposed relation to said first electrode, and said first domain of said ceramic resistor is a portion sandwiched between said first electrode and said second electrode, and said third electrode is provided on one face of said thin layer and positioned in spaced relation to said first electrode, and said second domain of said ceramic resistor is a portion of said thin layer sandwiched between said first electrode and said third electrode.

3. A self-temperature controlling type heating device according to claim 2, wherein said second domain of said ceramic resistor has a characteristic in which a logarithm of a ratio of resistance value at 200° C. to that of 20° C. is more than 3.

4. A self-temperature controlling type heating device according to claim 3, wherein the thickness of said first domain of said ceramic resistor is from 20 to 200 microns.

5. A self-temperature controlling type heating device according to claim 4, wherein said thin layer of said ceramic resistor has an almost uniform thickness throughout the entirety thereof, and said third electrode is provided on the same face as said first electrode of said thin layer.

6. A self-temperature controlling type heating device according to claim 1, wherein said ceramic resistor is principally composed of titanium barium and integrally has a thin layer portion and a stepped section having a stepped thick layer portion adjacent to said thin layer portion, said first electrode is provided on one face of said thin layer portion and one face of said thick layer portion, said second electrode is provided on the other face of said thin layer portion opposite to said first electrode, and said first domain of said ceramic resistor is a portion sandwiched between said first electrode and said second electrode, and said third electrode is provided on the other face of said thick laye portion opposite to said first electrode, and said second domain of said ceramic resistor is a portion of said thick layer portion between said first electrode and said third electrode.

* * * * *